United States Patent [19]

Cassidy

[11] 4,288,989

[45] Sep. 15, 1981

[54] METHOD AND APPARATUS FOR OBTAINING MECHANICAL ENERGY FROM LOW TEMPERATURE HEAT SOURCES

[76] Inventor: James L. Cassidy, 66 Prospect St., Turners Falls, Mass. 01376

[21] Appl. No.: 21,561

[22] Filed: Mar. 19, 1979

Related U.S. Application Data

[63] Continuation-in-part of Ser. No. 9,163, Feb. 5, 1979, Pat. No. 4,235,080.

[51] Int. Cl.[3] ..... F01K 9/00

[52] U.S. Cl. ..... 60/685; 60/646; 60/692

[58] Field of Search ..... 60/685, 688, 689, 690, 60/692, 693, 715, 655, 646, 657

[56] References Cited

U.S. PATENT DOCUMENTS 3,903,700 9/1975 Glickman ..... 60/641
4,109,470 8/1978 Cassidy ..... 60/692 X

FOREIGN PATENT DOCUMENTS 104175 4/1924 Switzerland ..... 60/655

*Primary Examiner*—Allen M. Ostrager
*Assistant Examiner*—Stephen F. Husar
*Attorney, Agent, or Firm*—Ross, Ross & Flavin

[57] ABSTRACT

It is possible to extract mechanical energy from lower temperature heat sources than the flames of burning fuel by substituting driving fluids having lower boiling points than water and using an abentropic engine of the type described in my U.S. Pat. No. 4,109,470, both to condense the fluid for recycling and to obtain mechanical energy from the latent heat of the vapor. Thus, valuable energy sources now going to waste such as geothermal heat, solar heat, factory and power house smoke stack heat, and nuclear-waste heat are made to produce electricity via mechanical energy, virtually a reversal of the second law of thermodynamics, by use of an abentropic engine whose operational principle is that the latent heat of vapor is in fact potential energy which can be converted to mechanical energy during its condensation. Actually, the second law is not violated any more so than occurs in the ordinary steam engine which elevates the availability level of the energy of burning fuel to the top level of availability of electric energy.

5 Claims, 3 Drawing Figures

METHOD AND APPARATUS FOR OBTAINING MECHANICAL ENERGY FROM LOW TEMPERATURE HEAT SOURCES

This is a continuation-in-part of my copending application Ser. No. 009,163 filed Feb. 5, 1979, now U.S. Pat. No. 4,235,080.

THE PRIOR ART

The prior art is restricted largely to the use of water vapor heated by burning fuel or mildly fissioning nuclear materials for transposing heat energy to mechanical and electrical energy. The chief reason for the restriction being the difficulty of economically and ecologically condensing driving fluids other than water so as to return them efficiently to the boilers for recycling because, obviously, spent vapors cannot be returned to boilers in the vapor form due to the face that the work necessary to return vapor to the boiler is equal to the work done in the engine by the emergent vapor. That is, PV of return equals PV of engine work, the same P and the same V and $PV-PV=0$. However, when condensed the volume V shrinks to approximately V/1670 and the work necessary to return the condensate to boiler becomes PV/1670. Since one of the above PVs represents external work done while the other represents latent heat energy, their equivalence as proven by the Clapyron-Clausius First Latent Heat Equation shows the importance of efforts made to conserve the energy contained in the latent heat of spent vapors.

THE INVENTION

This invention uses driving fluids having lower boiling points than the normal 212° F. boiling point of water for the reason that they exhibit satisfactory high vapor pressures at low temperatures and can readily be condensed in an abentropic type engine. Their heated vapors are used first to drive a standard turbine, then its exhaust or spent vapor is led into an abentropic engine wherein it impinges a specially designed rotor blade backed by a hard vacuum. This unbalanced force, provided it is greater than the rotor resistance, moves the rotor and work is done which in turn extracts energy from the vapor causing an amount proportional to the work done to condense at its boiling point. The condensate is drained away prior to being recycled through the boiler. The boiling condensate has qualities quite different from cold condensate; it does not leave a vacuum in its wake as cold condensate does, but exudes vapor at the same pressure as the uncondensed vapor itself and its temperature remains the same as that of the condensing vapor. Thus, the driving pressure is maintained and the engine continues to operate by virtue of the latent heat content of the vapor. The abentropic engine is thus a constant pressure constant temperature engine. Since it is desirous to prevent the driving fluid from escaping into the atmosphere, a safe containment tank with an automatic valve allowing escape from the system into the tank is provided for cases of emergency blow-off. Also, a well insulated cold sump tank for use with very low temperature boiling point fluids together with an injection pump are provided.

The advantages in the use of this system are many. The waste heat from power station and factory chimneys can be converted to mechanical energy by positioning a heat exchanger vapor pressure generator in the stack similar to presently used economizers. Heat from low temperature geothermal spots can likewise be used. Solar type panels can be converted to pressure supplying generators. Nuclear wastes can serve as low temperature heat sources, the revenue from which can serve to finance perpetual care and upkeep.

Installations in tropical hot spots such as deserts can provide storable energy by the electrolitic generation of hydrogen gas which in turn can be consolidated into methane and more compact hydrocarbons for easier storage and transportation to distant places.

The size of installations can vary from small individual types no more complex than a modern refrigerator for emergency service in households to large sizes suitable for power station use.

THE DRAWING

DETAILED DESCRIPTION OF THE DRAWING

THE FIGURE 1 EMBODIMENT

Figure 1:
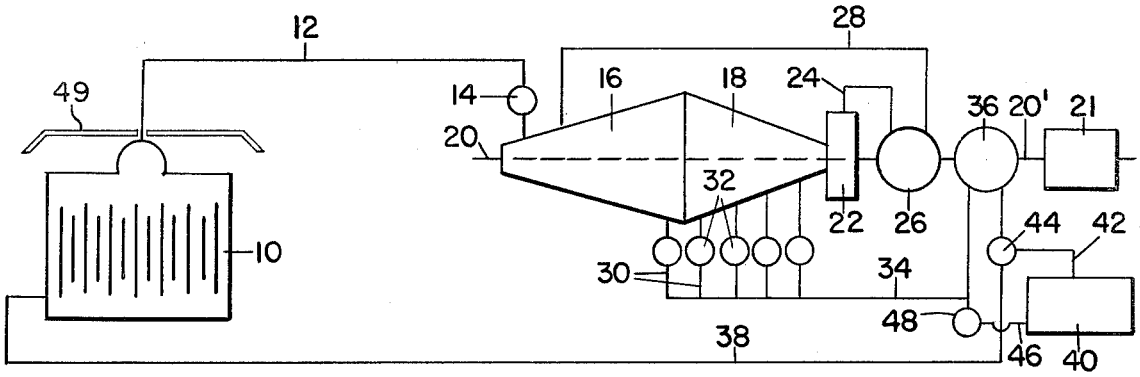
FIG. 1 is a schematic showing of a simple individual type unit embodying the invention.

FIG. 1 is a schematic showing of a simple individual type unit embodying the invention. A heat exchanger vapor pressure generator 10 placed in juxtaposition with a suitable low temperature heat source, not shown, is provided for generating vapor pressure from suitable driving fluids having a desired low boiling point, the driving fluids having lower boiling points than the normal 212° F. boiling point of water for the reason that they exhibit satisfactory high vapor pressures at low temperatures and can readily be condensed.

Figure 3:
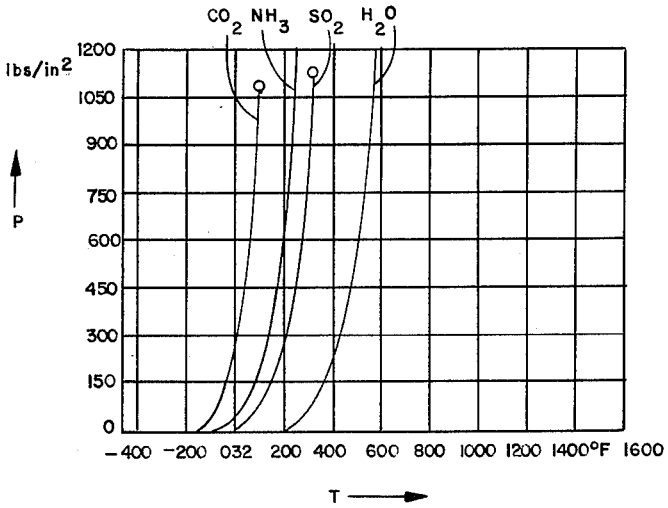
FIG. 3 is a chart showing vapor-pressure curves for several substances.

FIG. 3 is a chart showing the vapor pressures that may be obtained from fluids with lower boiling points than that of water. It will be noted that practically the same level of pressure can be had from such fluids at much lower temperatures than with water. Many other fluids having lower boiling points than water are available as, for instance the halogenated hydrocarbons of the paraffine series.

Heat exchanger vapor pressure generator 10 is linked through a line 12 having a valve 14 therein to a combination turbine 16 and expansible chamber type abentropic engine 18 mounted on a common drive shaft 20 which extends longitudinally therethrough. Engine 18 is provided with sufficient jacketing and insulation, not shown, to retain constant temperature therein.

Abentropic engine 18 is an expansible chamber turbine-type engine including rotor blades, not shown, the engine being of modified design so as to operate at low pressures and temperatures and having a working end specially designed to handle low pressure wet vapors. Unlike an ordinary engine, however, which runs on a diminishing pressure gradient, abentropic engine 18 runs at constant pressure and temperature and produces no exhaust vapor, all of the inlet vapor being reduced to liquid condensate by means to be described. The modifications consist of changes of shape to suit changes of vapor volume, installation of insulation and jacketing, not shown, to preserve constant temperature, and installation of a system of drainage ducts, to be described, properly valved to lead off the condensate.

Turbine 16 feeds its spent vapor into the working end of abentropic engine 18 wherein it condenses near its boiling point, yielding its latent energy to assist the turbine in driving an electric generator 21 or the like carried by an extension 20' of drive shaft 20 and extending outwardly from engine 18.

A vacuum chamber 22 disposed at one end of engine 18 is connected by a line 24 to a vacuum pump 26 also connected by a line 28 to turbine 16. Pump 26 sets up a hard vacuum in vacuum chamber 22, the hard vacuum opposing the low pressure of spent turbine steam in abentropic engine 18, causing the turbine rotor thereof, not shown, to move.

Cold condensate is drawn off from turbine 16 and the non-working end of engine 18 via a plurality of drainage lines or ducts 30 having valves 32 therein to a line 34 which connects with an injection pump 36.

A return line 38 leads from injection pump 36 to heat exchanger 10. To prevent the driving fluid from escaping into atmosphere, an insulated safe containment tank or blow-off tank 40 is provided and is connected to return line 38 by an insulated line 42 having an automatic valve 44 therein allowing escape from the system into the tank in cases of emergency blow-off.

An insulated fluid return line 46 connects between tank 40 and line 34 leading to pump 36 and has a valve 48 therein for automatically returning fluid to the system as pressure returns to normal.

It should be explained that boiler blow-off occurs either when the pressure in the boiler gets too high or when the load lessens. Power stations rarely have a blow-off because both load and steam pressure are steady enough for long periods. Herein, a steady temperature of the heat source cannot be guaranteed in all cases. Also, ecologists are demanding safety factors if only for eventualities.

As an additional ecological safety measure, shading means 49 may be provided for shielding vapor pressure generator 10 from excessive heat above the contemplated range in cases where such occasionally occurs.

As indicated above, means are provided for containment and return for blow-off. By providing shutters or shading means or the like, depending on the situation encountered to alleviate sudden bursts of heat on the vapor pressure generator, the need for blow-off can be eliminated. However, the shutters or shading means must be tailored to each situation.

OPERATION OF THE FIG. 1 EMBODIMENT

Vapor pressure is generated from a suitable fluid having a desired low boiling point at heat-exchanger vapor pressure generator 10 and the pressurized vapor is fed through line 12 to turbine 16 for expansion for obtaining useful work.

The spent vapor is lead from turbine 16 into abentropic engine 18 wherein vacuum pump 26 and vacuum chamber 22 provide a vacuum on the non-working end against which the spent vapor is forced to do work by virtue of the pressure imbalance, which work extracts energy from the spent vapor causing a proportionate amount of it to condense at its boiling point. Since the vapor pressure and temperature of the boiling condensate are the same as those of the vapor itself, the motion of the engine is continuous.

The resultant condensate is led at its boiling point through lines 30, valves 32 and line 34 to injection pump 36 for recycling.

Remaining uncondensed vapor is removed by vacuum pump 26 and lead through line 28 to a suitable location in turbine 16 for recycling.

THE FIG. 2 EMBODIMENT

Figure 2:
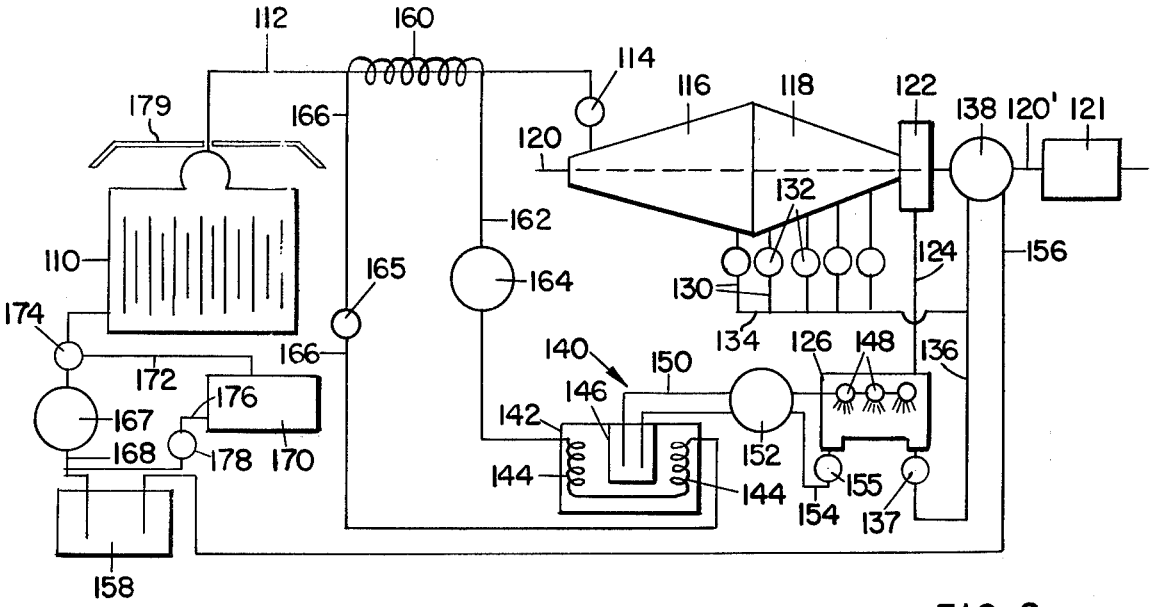
FIG. 2 is a schematic showing of a larger type unit embodying the invention.

FIG. 2 is a schematic showing of a larger type unit embodying the invention. A heat exchanger vapor pressure generator 110 placed in juxtaposition with a suitable low temperature heat source, not shown, for generating vapor pressure from a suitable fluid having a desired low boiling point of the type previously described is linked through a line 112 having a valve 114 therein to a combination turbine 116 and abentropic engine 118 of the type described with reference to the embodiment of FIG. 1, and mounted on a common drive shaft 120 which extends longitudinally therethrough.

As with the FIG. 1 embodiment, turbine 116 feeds its spent vapor into the working end of abentropic engine 118 wherein it condenses near its boiling point yielding its latent energy to assist the turbine in driving an electric generator 121 or the like 120' carried by an extension of drive shaft 120 and extending outwardly from engine 118.

A vacuum chamber 122 disposed at one end of engine 118 is connected by a line 124 to a vacuum or cold condenser 126, to be described, for setting up a hard vacuum in vacuum chamber 122, the hard vacuum opposing the low pressure of spent turbine steam in abentropic engine 118 causing the turbine rotor thereof, not shown, to move.

Cold condensate is drawn off from turbine 116 and the non-working end of engine 118 via a plurality of drainage lines or ducts 130 having valves 132 therein to a line 134 which connects with a line 136 leading from a vacuum pump 138 and connected to vacuum or cold condenser 126, line 136 having a valve 137 therein for regulating take-off of fluid from the cold or condenser.

A refrigeration means, generally indicated by 140, is provided for cooling vacuum condenser 126. Cooling is done in two stages, the refrigeration means including a brine bath 142 cooled by coils 144, or the like, as the first stage, the bath in turn, as a second stage, maintaining recycled cold condensate in a tank 146 at a temperature sufficiently above the freezing point to prevent icing of spray nozzles 148 located in vacuum condenser 126.

Condensate passes from tank 146 by a line 150 through a cold condensate circulating pump 152 to the spray nozzles and is recirculated from vacuum or cold condenser 126 back through cold condensate circulating pump 152 to tank 146 by a return line 154 which has a valve 155 therein for regulating take-off of fluid from the vacuum or cold condenser.

A line 156 leads from pump 138 to a cold sump 158 which is well insulated for use with very low temperature boiling point fluids.

A heat exchanger 160 is provided for returning heat to the system, with the line 112 which connects between heat exchange vapor pressure generator 110 and turbine 116 passing therethrough.

A line 162 connecting between one of the coils 144 of refrigeration means 124 passes through a pump 164 to one end of heat exchanger 160. A line 166 which connects between the other end of the heat exchanger and the other coil 144 has a pressure relief valve 165 therein.

An injection pump 167 is disposed in a line 168 connecting between cold sump 158 and heat exchanger vapor pressure generator 110.

As with the FIG. 1 embodiment, to prevent the driving fluid from escaping into atmosphere, an insulated safe containment tank or blow-off tank 170 is provided and is connected to line 168 by an insulated line 172 having an automatic valve 174 therein allowing escape from the system into the tank in cases of emergency blow-off.

An insulated fluid return line 176 connects between tank 170 and line 168 leading to pump 167 and has a valve 178 therein for automatically returning fluid to the system as pressure returns to normal.

Also, as with the FIG. 1 embodiment, as an additional ecological safety measure, shading means 179 may be provided for shielding vapor pressure generator 110 from excessive heat above the contemplated range in cases where such occasionally occurs.

OPERATION OF THE FIG. 2 EMBODIMENT

The FIG. 2 embodiment operates in the same manner as the FIG. 1 embodiment, except that the remaining uncondensed vapor in engine 118 is removed via line 122 and 136 to cold condenser 126 where it is cooled by a controlled spray of condensate from nozzles 148 chilled to a desired low temperature by refrigeration means 140.

The overage of cold condensate is lead through heat exchanger 160 which is attached to the hot coil 144 of the refrigeration means.

I claim:

1. A process for obtaining mechanical energy from heat sources having, in general, temperatures lower than those provided by burning fuel or fissioning fresh nuclear material, comprising:

a. generating vapor pressure from a suitable fluid having a desired low boiling point in a heat-exchanger vapor pressure generator placed in juxtaposition with a suitable low temperature heat source;

b. leading the pressurized vapor through a turbine for expansion for obtaining useful work;

c. leading the spent vapor from the turbine into an expansible chamber-type abentropic engine having working and non-working ends, the engine being of modified turbine type with blades designed to handle low pressure wet vapor as it condenses, the engine being mounted on the same shaft as the turbine which feeds it and being jacketed and insulated to preserve a constant temperature;

d. maintaining a vacuum on the non working end of the engine against which the spent exhaust vapor is forced to do useful work by virtue of its higher residual vapor pressure which brings about condensation at the boiling point of an amount of vapor proportionate to the work done and since the vapor pressure and temperature of the boiling condensate are the same as those of the condensing vapor, the engine operates continuously by virtue of the latent heat of the vapor;

e. leading the resultant condensate near its boiling point to a vapor pressure generator injection pump via valved ductwork for return to the heat exchanger vapor pressure generator to be recycled;

f. repeating the above sequence;

g. utilizing the mechanical work done as expedience may require;

h. removing the minor portion of uncondensed vapor with a vacuum pump for the purpose of producing a vacuum in the non-working end of the expansible chamber type abentropic engine; and i. leading the removed vapor from the vacuum pump to a suitable section of the turbine for recycling therein.

2. A process for obtaining mechanical energy according to claim 1, including:

j. providing a valve and insulated safe containment tank in the line between the injection pump and the heat exchanger vapor pressure generator for allowing release of over pressure vapor of the system in case of emergency blow-off.

3. A process for obtaining mechanical energy according to claim 2, including:

k. providing a valved and insulated line leading from the safe containment tank to the injection pump for automatically returning fluid to the system as pressure returns to normal.

4. A process for obtaining mechanical energy from heat sources having, in general, temperatures lower than those provided by burning fuel or fissioning fresh nuclear material, comprising:

a. generating vapor pressure from a suitable fluid having a desired low boiling point in a heat exchanger vapor pressure generator placed in juxtaposition with a suitable low temperature heat source;

b. leading said vapor through a turbine for expansion for obtaining useful work;

c. leading the final exhaust vapor into an expansible chamber type of engine such as a modified turbine, with blades designed to handle low pressure wet vapor as it condenses and preferably mounted on the same line shaft as the turbine that feeds it;

d. wherein a vacuum is maintained in the non-working end of said expansible chamber device;

e. such that the spent exhaust vapor entering is forced to do useful work by virtue of its higher residual vapor pressure which brings about condensation at the boiling point of the major portion of the vapor an amount proportionate to the work done; and f. since the vapor pressure and temperature of the boiling condensate are the same as those of the condensing vapor, this type of engine operates continuously powered by the latent heat energy of the vapor;

g. leading said resulting condensate near its boiling point through a valved and insulated system of drainage ducts and a pump to a boiler feed sump;

h. removing the minor portion of uncondensed vapor with a vacuum pump for the purpose of producing a vacuum in the non-working end of the expansible chamber type engine;

i. leading the removed vapor from the pump to a suitable section of the turbine for recycling therein;

j. recycling the contents of the boiler feed sump through the boiler via the injection pump;

k. repeating steps a–j in a continuous cycle; and l. utilizing the mechanical work done as expedience may require.

5. A process for obtaining mechanical energy from heat sources having, in general, temperatures lower than those provided by burning fuel or fissioning fresh nuclear material, comprising:

a. generating vapor pressure from a suitable fluid having a desired low boiling point in a heat exchanger vapor pressure generator placed in juxtaposition with a suitable low temperature heat source;

b. leading said vapor through a turbine for expansion for obtaining useful work;

c. leading the final exhaust vapor into an expansible chamber type of engine such as a modified turbine, with blades designed to handle low pressure wet vapor as it condenses and preferably mounted on the same line shaft as the turbine that feeds it;

d. wherein a vacuum is maintained in the non-working end of said expansible chamber device;

e. such that the spent exhaust vapor entering is forced to do useful work by virtue of its higher residual vapor pressure which brings about condensation at the boiling point of the major portion of the vapor an amount proportionate to the work done; and f. since the vapor pressure and temperature of the boiling condensate are the same as those of the condensing vapor, this type of engine operates continuously powered by the latent heat energy of the vapor;

g. leading said resulting condensate near its boiling point through a valved and insulated system of drainage ducts and a pump to a boiler feed sump;

h. removing the minor portion of uncondensed vapor to a cold chamber condenser wherein cooling and condensing are accomplished by a controlled spray of condensate chilled in a refrigerator for the purpose of producing the vacuum needed in the non-working end of the expansible chamber type engine;

i. leading the overage of cold condensate from the cold condenser to the boiler feed sump via a pump;

j. recycling the heat from the refrigerator hot coil back through the system via a heat exchanger attached to the outlet line of the vapor pressure generator as a superheater;

k. recycling the contents of the boiler feed sump back through the vapor pressure generator via the injection pump;

l. repeating the steps a–k in a continuous cycle;

m. utilizing the mechanical energy produced as expedience may require;

n. providing a valved and insulated safe containment tank let into the vapor pressure generator for the purpose of allowing the release of over pressure vapor of the system in case of emergency blow-off;

o. providing a valved and insulated duct leading from the blow-off safe containment tank to the injection pump to automatically return fluid to the system as pressure returns to normal; and p. providing a means of shading for shielding the vapor pressure generator from excessive heat above the contemplated range in cases where such occasionally occurs as an additional ecological safety measure.

* * * * *